US008662953B1

(12) United States Patent
Tarr

(10) Patent No.: US 8,662,953 B1
(45) Date of Patent: Mar. 4, 2014

(54) TOY CAR APPARATUS

(76) Inventor: Jeannie M. Tarr, Ridgeland, SC (US)

( * ) Notice: Subject to any disclaimer, the term of this patent is extended or adjusted under 35 U.S.C. 154(b) by 272 days.

(21) Appl. No.: 13/049,545

(22) Filed: Mar. 16, 2011

(51) Int. Cl.
*A63H 3/28* (2006.01)
*A63H 17/00* (2006.01)

(52) U.S. Cl.
USPC ..... 446/175; 446/465

(58) Field of Classification Search
USPC ..... 446/175, 298, 436, 454, 97, 268, 484, 446/465; 700/245, 247
See application file for complete search history.

(56) References Cited

U.S. PATENT DOCUMENTS

| | | | | |
|---|---|---|---|---|
| 4,280,300 | A | 7/1981 | Kulesza et al. | |
| 4,454,411 | A * | 6/1984 | Hale et al. | 235/95 R |
| 5,456,604 | A * | 10/1995 | Olmsted et al. | 434/62 |
| 6,459,955 | B1 * | 10/2002 | Bartsch et al. | 700/245 |
| 6,604,641 | B2 * | 8/2003 | Wolf et al. | 213/75 TC |
| D534,967 | S | 1/2007 | Clark et al. | |
| 7,272,467 | B2 * | 9/2007 | Goncalves et al. | 700/245 |
| 7,275,975 | B2 | 10/2007 | Trageser et al. | |
| 7,594,843 | B2 | 9/2009 | Vetuskey | |
| 7,905,759 | B1 * | 3/2011 | Ghaly | 446/175 |
| 2009/0138150 | A1 | 5/2009 | Chou et al. | |

* cited by examiner

*Primary Examiner* — Kien Nguyen

(57) ABSTRACT

A toy car apparatus includes a toy vehicle including a housing and a plurality of wheels rotatably coupled to the housing. The housing has a front end, a rear end and a pair of lateral sides. An odometer is mounted in the housing and is engaged with one of the wheels. The odometer is coupled to an electronic memory to record a distance traveled by the toy vehicle.

6 Claims, 3 Drawing Sheets

TOY CAR APPARATUS

BACKGROUND OF THE DISCLOSURE

Field of the Disclosure

The disclosure relates to toy vehicle devices and more particularly pertains to a new toy vehicle device for allowing a child to measure the distance traveled by their toy vehicle.

SUMMARY OF THE DISCLOSURE

An embodiment of the disclosure meets the needs presented above by generally comprising a toy vehicle including a housing and a plurality of wheels rotatably coupled to the housing. The housing has a front end, a rear end and a pair of lateral sides. An odometer is mounted in the housing and is engaged with one of the wheels. The odometer is electrically coupled to an electronic memory to record a distance traveled by the toy vehicle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
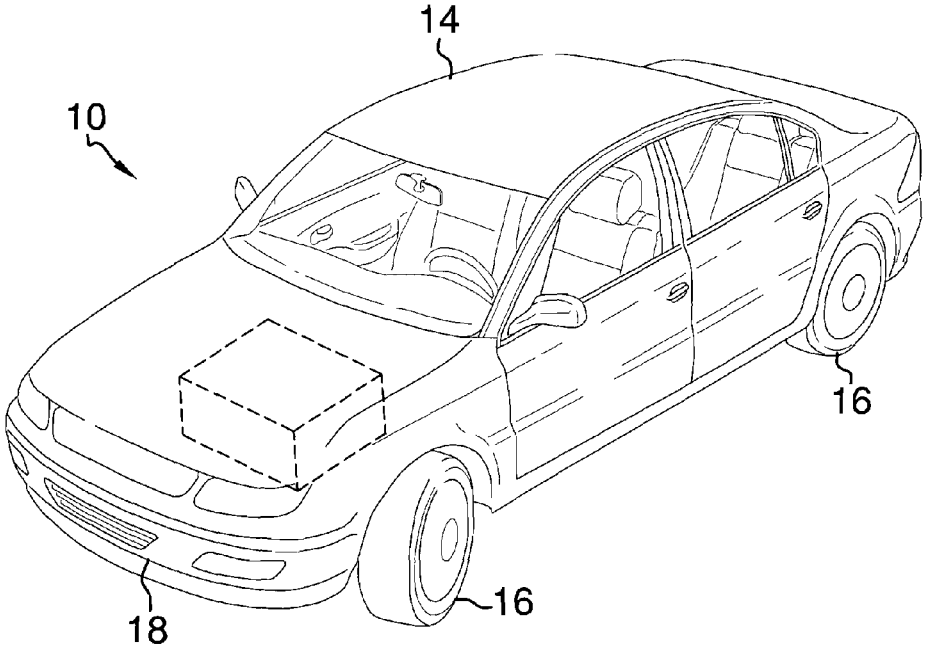
FIG. 1 is a top perspective view of a toy car apparatus according to an embodiment of the disclosure.
Figure 2:
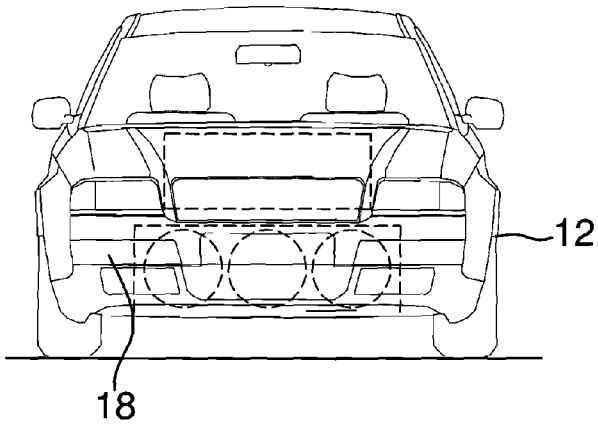
FIG. 2 is a front view of an embodiment of the disclosure.
Figure 3:
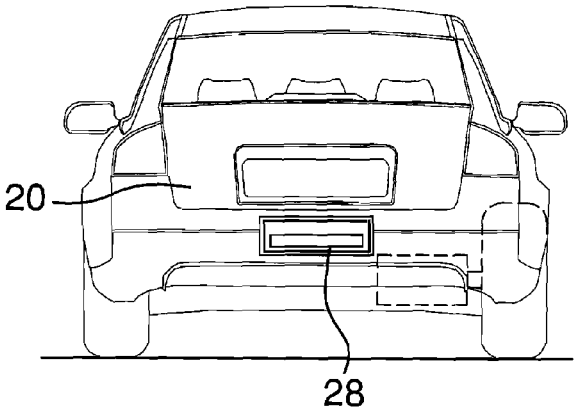
FIG. 3 is a rear view of an embodiment of the disclosure.
Figure 4:
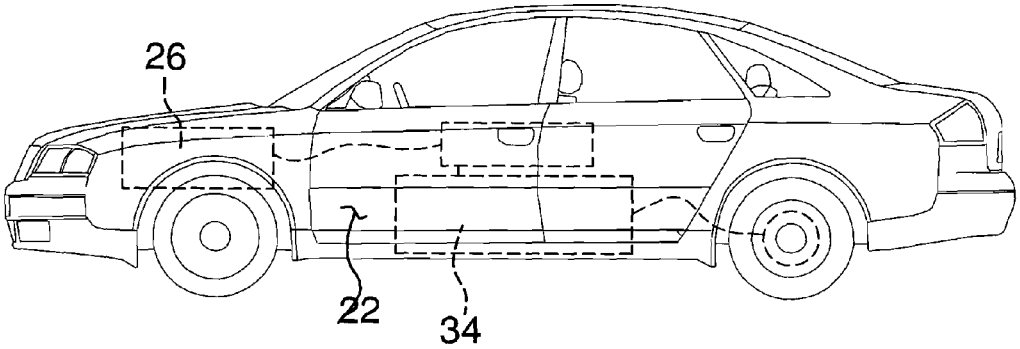
FIG. 4 is a side view of an embodiment of the disclosure.
Figure 5:
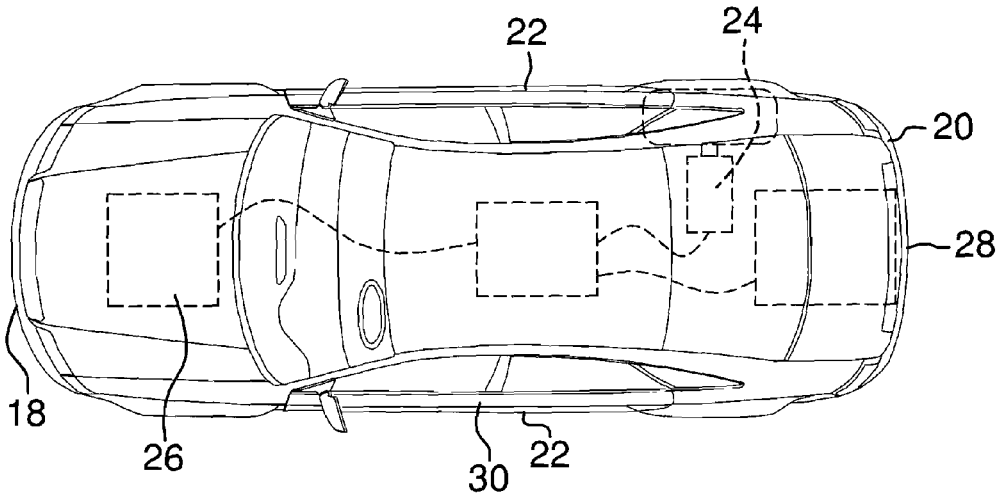
FIG. 5 is a top view of an embodiment of the disclosure.
Figure 6:
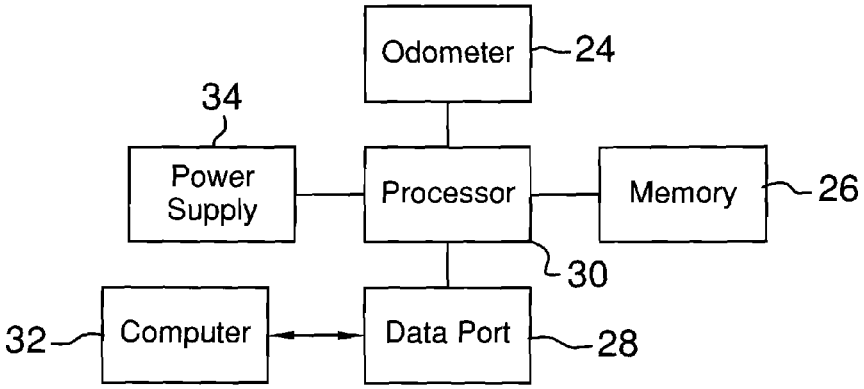
FIG. 6 is a schematic view of an embodiment of the disclosure.

With reference now to the drawings, and in particular to FIGS. 1 through 6 thereof, a new toy vehicle device embodying the principles and concepts of an embodiment of the disclosure and generally designated by the reference numeral 10 will be described.

As best illustrated in FIGS. 1 through 6, the toy car apparatus 10 generally comprises a toy vehicle 12 that includes a housing 14 and a plurality of wheels 16 that are rotatably coupled to the housing 14. The housing 14 has a front end 18, a rear end 20 and a pair of lateral sides 22. The housing 14 has a length from the front end 18 to the rear end 20 less than 40 cm and a width between the lateral sides 22 less than 20 cm. More particularly, the housing 14 may have a length less than 10 cm and a width less than 4 cm.

An odometer 24 is mounted in the housing 14 and is engaged with one of the wheels 16. The odometer 24 may comprise a conventional odometer assembly and is electrically coupled to an electronic memory 26 to record a distance traveled by the toy vehicle 12 and may be geared to measure the actual distance traveled by the wheel 16 to which the odometer 24 is engaged. In particular, the odometer 24 is electrically coupled to a processor 30 which sends the distance recorded to the electronic memory 26. It should be understood that the distance traveled, instead of being the actual distance, may be scaled up to a full sized vehicle. Thus, if the apparatus 10 is a 20:1 scaled version of a particular vehicle, the distance is scaled up 1:20.

A data transfer 28 is electrically coupled to the electronic memory 26 and is configured to transfer the distance traveled to a personal computer 32. The data transfer 28 may comprise a data port mounted on the housing 14, or the data transfer may comprise a transmitter to wirelessly transmit the distance to a personal computer 32 or other electric device configured to receive the distance traveled.

A power supply 34 is electrically coupled to odometer 24 and/or electronic memory 26. The power supply 34 comprises at least one rechargeable battery. A power port may be mounted on housing 14 and electrically coupled to the power supply 34, however, the data transfer 28, or data port, may also be used to recharge the power supply 34.

In use, the apparatus 10 is played with as a conventional toy vehicle and may be rolled across various surfaces such as dwelling floors, sidewalks and tabletops. As the apparatus 10 is rolled across the surface, the odometer 24 tracks the amount of distance traveled by the apparatus 10. This distance is then transferred to a personal computer 32 or other electronic device for tracking purposes. The distances traveled may then be compared, such as against others playing with similar devices, via the internet or other computing program.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A toy assembly comprising:

a toy vehicle including a housing and a plurality of wheels being rotatably coupled to said housing, said housing having a front end, a rear end and a pair of lateral sides; and an odometer being mounted in said housing and being engaged with one of said wheels, said odometer being electrically coupled to an electronic memory to record a distance traveled by said toy vehicle, the distance traveled by said toy vehicle being recorded in said electronic memory as a scaled value wherein the scaled value is configured to represent a corresponding distance traveled by a full-sized vehicle.

2. The assembly according to claim 1, wherein said housing has a length from said front end to said rear end less than 40 cm and a width between said lateral sides less than 20 cm.

3. The assembly according to claim 1, further including a data transfer being electrically coupled to said electronic memory and being configured to transfer said distance traveled to a personal computer to display the distance traveled on the personal computer.

4. The assembly according to claim 3, wherein said data transfer comprises a data port.

5. The assembly according to claim 1, further including a power supply being electrically coupled to odometer, said power supply comprising at least one rechargeable battery.

6. A toy assembly comprising:

a toy vehicle including a housing and a plurality of wheels being rotatably coupled to said housing, said housing having a front end, a rear end and a pair of lateral sides, said housing having a length from said front end to said rear end less than 40 cm and a width between said lateral sides less than 20 cm;

an odometer being mounted in said housing and being engaged with one of said wheels;

an electronic memory is electrically coupled to the odometer to record a distance traveled by said toy vehicle, the distance traveled by said toy vehicle being recorded in said electronic memory as a scaled value wherein the scaled value is configured to represent a corresponding distance traveled by a full-sized vehicle;

a data transfer being electrically coupled to said electronic memory and being configured to transfer said distance traveled to a personal computer, said data transfer comprising a data port; and a power supply being electrically coupled to odometer, said power supply comprising at least one rechargeable battery.

* * * * *